US005816889A

United States Patent [19]

Fildan

[11] Patent Number: 5,816,889

[45] Date of Patent: Oct. 6, 1998

[54] DECORATIVE LINK FOR UNDERWIRE BRASSIERE CUPS

[76] Inventor: Gerhard Fildan, Dr. Körner Str. 64, A-2521 Trumau, Austria

[21] Appl. No.: 856,129

[22] Filed: May 14, 1997

[51] Int. Cl.[6] ..... A41C 3/02; A41C 3/12

[52] U.S. Cl. ..... 450/45; 450/41; 2/255; 2/258; 24/163 R; D11/218; D11/200

[58] Field of Search ..... 2/73, 67, 244, 2/243.1, 105.7, 255, 259, 264, 336; 450/58, 72, 73, 45, 41, 42, 43, 44, 46, 47, 48, 49, 50, 51, 52; 63/1.1, 1.2, 1.11, 1.16; 24/163 R, 165, 168, 200, 326, 458, 459, 460, 466, 590; D8/323; D2/705, 709, 710; D11/200, 201, 208–210, 212, 216, 218, 34; D32/61

[56] References Cited

U.S. PATENT DOCUMENTS

D. 80,140 12/1929 Mix .
D. 97,048 10/1935 Freysinger .
D. 97,293 10/1935 Kestin .
D. 98,045 1/1936 Aterson .
D. 106,783 11/1937 Dorée .
D. 352,681 11/1994 Fildan ..... D11/218
D. 370,874 6/1996 Muller et al. ..... D11/218
D. 385,509 10/1997 Fildan ..... D11/218
2,463,319 3/1949 Schwartz ..... 450/45
2,769,180 11/1956 Tareau et al. ..... 450/45
3,754,285 8/1973 Greene ..... 2/336

*Primary Examiner*—Jeanette E. Chapman
*Attorney, Agent, or Firm*—Herbert Dubno

[57] ABSTRACT

A brassiere has a pair of fabric brassiere cups each provided with respective underwire cups extending through a fabric channel beneath the respective cup. The two cups are interconnected at the front of the brassiere by a decorative link composed of a molded synthetic resin and having a pair of sewing flanges each stitched through to the fabric of the cup. The underwires terminate at the respective sewing flanges.

19 Claims, 2 Drawing Sheets

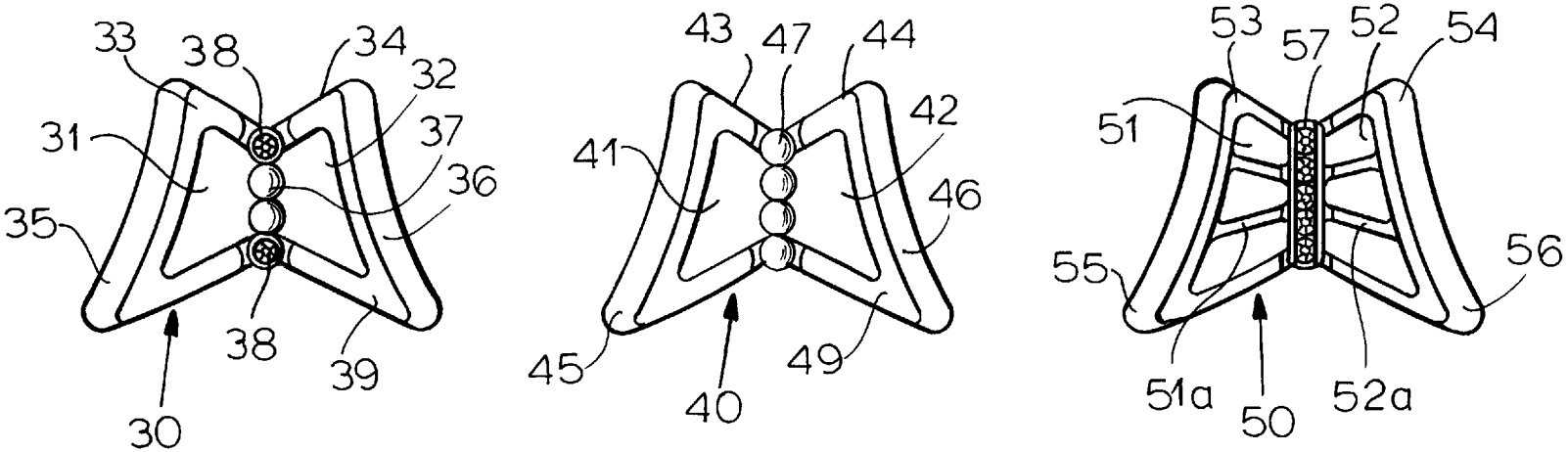
FIG.3
FIG.4
FIG.5
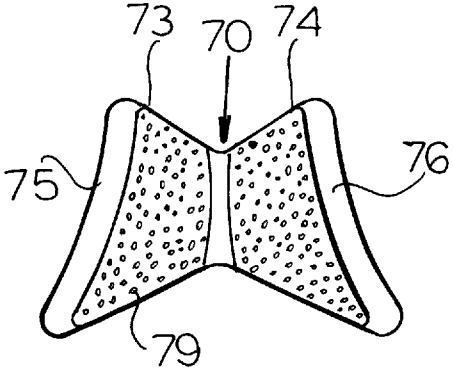
FIG.7
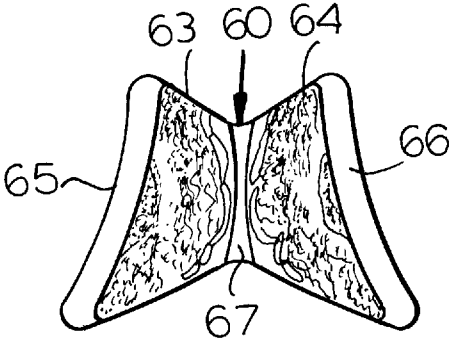
FIG.6

DECORATIVE LINK FOR UNDERWIRE BRASSIERE CUPS

FIELD OF THE INVENTION

My present invention relates to a brassiere of the underwire-cup type and, more particularly, to a decorative link for such a brassiere and to a brassiere provided with a decorative link.

BACKGROUND OF THE INVENTION

Brassieres with underwire cups are known. The fabric cups generally are formed below the cup with a channel between rows of stitching within which a so-called "underwire" may be received, the latter being a shape-imparting cup-stabilizing arcuate member running from a location close to a fabric connection between the two cups, to outer sides of the cups at which a back strap may be connected to them. The cups may also be provided with a shoulder strap for additional support.

While the fabric connection between the two cups could be decorative, its flexibility was found to be problematical particularly in cases in which the underwire was a preformed steel or other metal wire. The central connecting member between these cups of the brassiere could not contribute to the stability of the brassiere and in many cases shifting of the end of the wire tended to create problems.

OBJECTS OF THE INVENTION

It is, therefore, the principal object of the present invention to provide an improved brassiere of the underwire-cup type, whereby the drawbacks of earlier brassieres of this type can be obviated and the stability at the front center of the brassiere, where the two fabric cups are joined together, can be increased especially in the case of metal wire underwires.

Another object of the invention is to provide an improved decorative link for wired cups of such brassieres.

Still another object of the invention is to provide an improved brassiere with greater stability and improved esthetic appearance at the front central connection between the brassiere cups.

SUMMARY OF THE INVENTION

These objects and others which will become apparent hereinafter are attained, in accordance with the invention, with a decorative link between the fabric cups which is molded from a flexible synthetic resin and which is formed on its outer edges with sewing flanges so that it can be stitched into the cups at the region at which an underwire ends, thereby providing a somewhat stiffer front connection between the cups at the terminus of the underwires in this region.

More particularly, a brassiere of the invention can comprise:

a pair of fabric brassiere cups each provided with a respective underwire extending through a fabric channel below the respective cup; and a decorative link coupling the cups at a front of the brassiere, the link being composed of a molded synthetic resin and having a pair of sewing flanges each stitched through to the fabric of the respective cup, each of the underwires having an end terminating at the respective sewing flange.

The link can have a vertical central bar between a pair of wings, the sewing flanges being formed along the outer lateral edges of the wings.

According to a feature of the invention, the link has a butterfly shape and can be formed with a pearl pattern, preferably on this bar. Each of the wings can have an opening alongside the bar through which the fabric of the brassiere may show through or the opening may be unobstructed so that the link is of the see-through type.

Each of the wings can be formed with an embossed pattern extending to the respective sewing flange and such embossed pattern can be a fabric pattern.

The link is preferably composed of a polyamide, a polyurethane or a polyethylene or a blend or combination thereof.

While the use of the link has been found to be most advantageous, in the case of an underwire brassiere utilizing a metal underwire, it can be employed as well with a synthetic resin or thermoplastic underwire which may be formed with a stitching flange through which the underwire can be anchored in its channel in the cup. In that case, the flange of the underwire may be sewn to the sewing flange of the decorative link of the invention.

BRIEF DESCRIPTION OF THE DRAWING

The above and other objects, features, and advantages will become more readily apparent from the following description, reference being made to the accompanying drawing in which:

FIGS. 3–7 are elevational views of other links which may be used in place of the link of FIG. 1.

SPECIFIC DESCRIPTION

Figure 1:
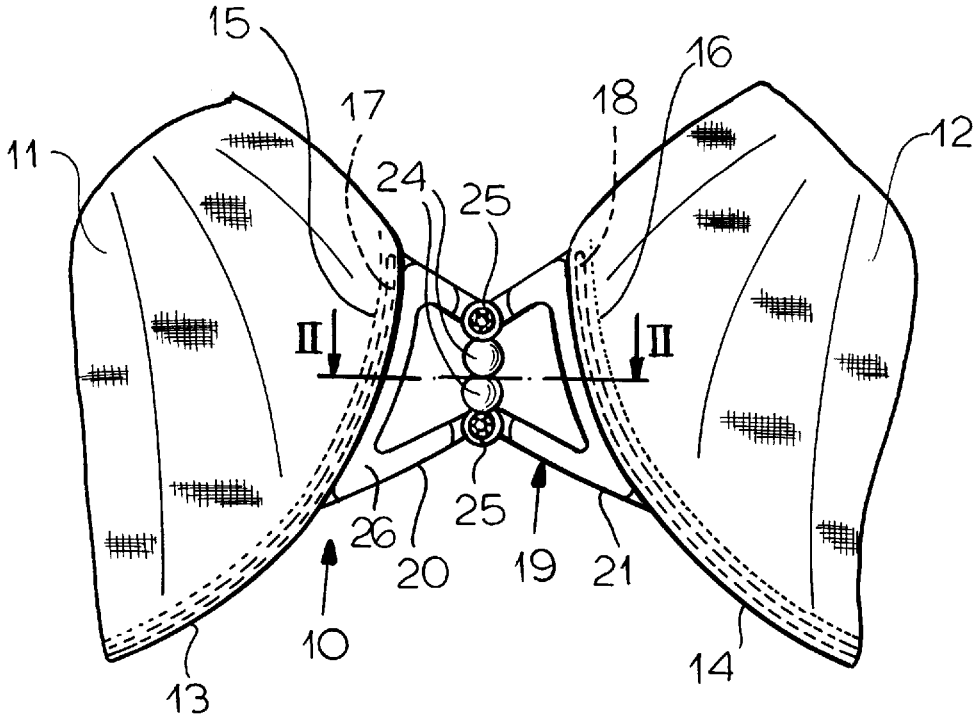
FIG. 1 is a fragmentary elevational view of the central portion of a brassiere showing two underwire cups held together by a decorative link according to the invention.

In FIG. 1, I have shown an underwire brassiere 10 comprising a pair of fabric cups 11, 12 with respective tubular channels 13 and 14 formed by stitching 15, 16 and receiving respective metal underwires 17 and 18 which terminate at a decorative link 19. The decorative link is of a butterfly configuration with a pair of wings 20 and 21 which can terminate in sewing flanges, one of which is visible at 22 in FIG. 2 but neither of which is visible in FIG. 1 since they have been stitched to the respective cups.

A central bar 23 between the wings 20 and 21 may carry a decoration, such as a pearl decoration 24 and/or a rhinestone decoration as shown at 25. Furthermore, up to the sewing flange, the link may have an embossed surface 26 of a fabric pattern.

Figure 2:
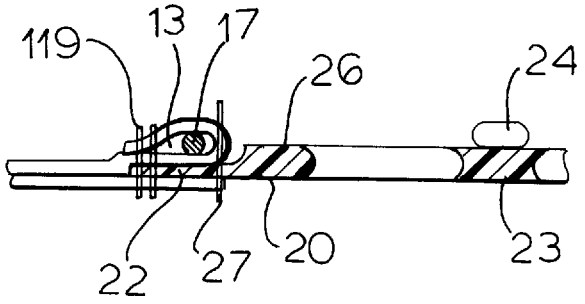
FIG. 2 is an enlarged cross sectional view along the line II—II of FIG. 1.

As can be seen from FIG. 2, a row of stitching 119, which closes off the channel 13 receiving the metal wire 17, can pass through the flange 22. On the outer side of the channel another row of stitching as shown at 27 can be provided through the stitching flange 22 as well.

The result is a polyamide link between two cups that provides a highly stable connection where the metal wires of the cups terminate.

Other decorative link configurations have been shown in FIGS. 3–7.

For example, like the link 19 of FIGS. 1 and 2, the link 30 of FIG. 3 may have openings 31 and 32 in the wings 33 and 34 and can be provided with the sewing flanges 35 and 36 along the outer edges of the decorative link. The central bar, as in the case of the link 19, has a pair of pearl formations 37 and rhinestone formations 38 for decorative purposes. The surface 39 is, however, not provided with fabric embossing.

This decorative link can also be composed of a polyamide.

The decorative link 40 of FIG. 4 provides a set of four pearl formations 47 on the central bar and the wings 43 and 44 are again formed with openings 41 and 42 and with sewing flanges 45 and 46. The surface 49 is not embossed with a fabric pattern.

Another butterfly configuration for the decorative link is shown at 50 in FIG. 5 and here the wings 53 and 54 have their openings 51 and 52 spanned by bars 51*a* and 52*a*. The sewing flanges are shown at 55 and 56 and the central bar is provided with molded decorative rhinestone units 57 or with actual stones inset in that bar.

The butterfly link 60 of FIG. 6 has a central bar 67 which is embossed and wings 63 and 64 which are embossed, e.g. with a decorative pattern inwardly of the sewing flanges 65 and 66. A similar decorative link 70 has a different pattern 79 on the wings 73 and 74 inwardly of the sewing flanges 75 and 76. The decorative links of FIGS. 3–7, of course, are stitched to the cups in the manner which has been described in connection with FIGS. 1 and 2.

I claim:

1. A brassiere comprising:

a pair of fabric brassiere cups each provided with a respective underwire extending through a fabric channel below the respective cup; and a decorative link coupling said cups at a front of the brassiere, said link being composed of a molded synthetic resin and having a pair of sewing flanges each stitched through to the fabric of the respective cup, each of said underwires having an end terminating at the respective sewing flange.

2. The brassiere defined in claim 1 wherein said link has a vertical central bar between a pair of wings, said wings being formed with said flanges along lateral edges of said wings.

3. The brassiere defined in claim 2, further comprising means forming a pearl pattern on said bar.

4. The brassiere defined in claim 2 wherein each of said wings is formed with an opening alongside said bar.

5. The brassiere defined in claim 2 wherein each of said wings is formed with an embossed pattern extending to the respective sewing flange.

6. The brassiere defined in claim 5 wherein said embossed pattern is a fabric pattern.

7. The brassiere defined in claim 2 wherein said sewing flanges are curved to follow curved contours of said cups.

8. The brassiere defined in claim 2 wherein said link is composed of at least one synthetic resin selected from the group which consists of polyamide, polyethylene or polyurethane.

9. The brassiere defined in claim 8 wherein said link is composed of a polyamide.

10. The brassiere defined in claim 8 wherein said link is composed of a polyamide/polyethylene blend.

11. The brassiere defined in claim 8 wherein said link is composed of polyurethane.

12. A decorative link for coupling a pair of underwire cups of a brassiere at a front of said brassiere, said link being composed of a molded synthetic resin and having a central bar and a pair of wings extending from said central bar, each of said wings having:

a respective convexly inwardly curved outer edge formed with a sewing flange adapted to be stitched through to the fabric of a respective cup, and a respective pair upper and lower edges bridged by the respective one of said outer edges.

13. The decorative link defined in claim 12 wherein said bar is formed with a plurality of pearls.

14. The decorative link defined in claim 12 wherein each of said wings is formed with an opening alongside said bar.

15. The decorative link defined in claim 12 wherein each if said wings is formed with a fabric extending between the respective outer and upper lower edges and the bar, said fabric being formed with an embossed pattern.

16. The decorative link defined in claim 12 wherein said sewing flanges are curved to follow curved contours of said cups.

17. The decorative link defined in claim 12 wherein said link is composed of at least one synthetic resin selected from the group which consists of polyamide, polyethylene or polyurethane.

18. The decorative link defined in claim 12, further comprising a rhinestone pattern on said bar.

19. The decorative link defined in claim 14 wherein each of said wings has bars extending across the respective opening.

* * * * *